US006401815B1

(12) United States Patent
Surjaatmadja et al.

(10) Patent No.: US 6,401,815 B1
(45) Date of Patent: Jun. 11, 2002

(54) APPARATUS AND METHOD FOR CONNECTING CASING TO LATERAL CASING USING THERMOSET PLASTIC MOLDING

(75) Inventors: Jim B. Surjaatmadja; Gary T. Keene, both of Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/522,973

(22) Filed: Mar. 10, 2000

(51) Int. Cl.[7] ..... E21B 29/10; E21D 11/00; F16L 55/162

(52) U.S. Cl. ..... 166/277; 166/50; 166/207; 166/288; 166/313; 138/98; 405/150.1

(58) Field of Search ..... 138/98, 109; 166/50, 166/288, 300, 376, 295, 60, 277, 207, 217, 313, 117.5, 242.3; 405/150.1

(56) References Cited

U.S. PATENT DOCUMENTS

| | | | | |
|---|---|---|---|---|
| 4,850,431 A | | 7/1989 | Austin et al. | 166/308 |
| 5,318,122 A | * | 6/1994 | Murray et al. | 166/313 |
| 5,329,063 A | * | 7/1994 | Endoh | 138/98 |
| 5,337,823 A | * | 8/1994 | Nobileau | 166/277 |
| 5,499,681 A | | 3/1996 | White et al. | 166/382 |
| 5,564,503 A | | 10/1996 | Longbottom et al. | 166/313 |
| 5,566,763 A | | 10/1996 | Williamson et al. | 166/382 |
| 5,613,559 A | | 3/1997 | Williamson et al. | 166/381 |
| 5,730,224 A | | 3/1998 | Williamson et al. | 166/386 |
| 5,735,350 A | | 4/1998 | Longbottom et al. | 166/313 |
| 5,836,357 A | * | 11/1998 | Kittson et al. | 138/98 |
| 5,964,288 A | * | 10/1999 | Leighton et al. | 166/207 |

FOREIGN PATENT DOCUMENTS

| | | |
|---|---|---|
| WO | WO 94/25655 | * 11/1994 |
| WO | WO 97/06345 | * 2/1997 |

* cited by examiner

*Primary Examiner*—David Bagnell
*Assistant Examiner*—Jennifer H Gay
(74) *Attorney, Agent, or Firm*—John W. Wustenberg; Neal R. Kennedy

(57) ABSTRACT

An apparatus for connecting a main casing section to a lateral casing section using thermoset plastic molding. The apparatus is used to set a flexible sock made of a hardenable material at a location adjacent to an intersection between the main and lateral casing sections. The sock is inflated so that it conforms to the inner surfaces of the main and lateral casing sections. Heat is applied to the hardenable material so that the sock is cured in the inflated, operating position. Heat may be applied by releasing chemicals which provide an exothermic reaction and/or by using a heater positioned within the sock.

36 Claims, 1 Drawing Sheet

APPARATUS AND METHOD FOR CONNECTING CASING TO LATERAL CASING USING THERMOSET PLASTIC MOLDING

BACKGROUND OF THE INVENTION

1. Field of the Invention

This invention relates to connecting a main casing section to a lateral casing section in a well, and more particularly, to an apparatus and method using a thermoset plastic molding in the form of a sock seal at the intersection of the casing sections.

2. Description of the Prior Art

Many oil and gas wells today include a laterally extending portion which extends away from a substantially vertical main portion of the well. These lateral sections, also sometimes referred to as horizontal sections or deviated sections, are used to intersect formations or zones of interest that cannot easily be accessed by merely a vertical well.

After a vertical portion of the well and a lateral portion have been drilled, casing is placed in both. At the intersection or joint of the main or vertical section of casing with the lateral section of casing, it is necessary to provide sealing so that proper well operations may be carried out and well fluids flowed out of the well without leakage in or out of the well casing.

Sealing at the joint or intersection presents problems, solutions to which have been proposed through the years. For example, sealing can be successfully achieved by using cements or other similar materials. However, a problem exists in keeping such a seal intact. Any slight earth movements, or pipe movements due to contraction or expansion in the casing may sever such seals. In these instances, the cement will crack, breaking the seal, and allowing leakage into or out of the casing joint, neither of which is desirable.

The present invention solves this problem by providing a flexible sock made of a hardenable material which can be placed at the joint so that the legs of the sock extend into the main casing section and the lateral casing section. The sock is inflated to an operating position and the material hardened. In this way, a single piece, uninterrupted seal is formed. Even with some casing or earth movement, the integrity of the one-piece seal is not broken.

SUMMARY OF THE INVENTION

The present invention includes an apparatus for sealing a connection between a main casing section and a lateral casing section in a well. The apparatus comprises a housing adapted for attachment to a tubing string and a sock having an upper end attached to the housing. The sock also has a first leg and a second leg and is made of a hardenable material. The apparatus may further comprise a bent sub connected to the housing and extending through the second leg of the sock. The housing, sock and bent sub may be positioned in the well adjacent to an intersection of the main and lateral casing sections, the sock may be inflated and placed in an operating position in which the first leg of the sock extends into the main casing section beyond the intersection and the second leg extends into the lateral casing section beyond the intersection, and the sock may be hardened in the operating position.

In one embodiment, the first leg of the sock has a closed end. The housing and the upper end of the sock are sealingly engaged, and the bent sub and the second leg of the sock are also sealingly engaged.

The sock is preferably made of a thermoset plastic material, and the apparatus may thus further comprise heating means for applying heat to the sock and thereby hardening the sock in the operating position. The heating means may comprise a heater connected to the housing and/or may comprise chemicals disposed in a cavity defined in the housing for providing an exothermic reaction when released from the cavity. The apparatus may thus comprise a rupture disc in communication with the cavity such that the rupture disc may be ruptured by applying pressure thereto, thereby releasing the chemicals from the cavity.

The invention may also be described as including a method of connecting and sealing between a main casing section and a lateral casing section in a well. The method comprises the steps of (a) positioning a flexible sock made of a hardenable material adjacent to an intersection of the main and lateral casing portions, the sock comprising a first leg and a second leg, (b) placing the sock in an operating position wherein the first leg of the sock is in contact with an inner surface of the main casing section, and the second leg of the sock is in contact with an inner surface of the lateral casing section, and (c) curing the hardenable material such that the sock is hardened in the operating position. Step (b) may comprise inflating the sock. Steps (b) and (c) may be substantially simultaneous.

Step (c) may comprise applying heat to the hardenable material. This step of heating may comprise releasing a volume of chemicals adjacent to the sock such that an exothermic reaction is generated and/or activating a heater positioned adjacent to the sock. The step of releasing the chemicals may comprise rupturing a rupture disc retaining the chemicals in a cavity defined in a housing positioned inside the sock.

Numerous objects and advantages of the invention will become apparent as the following detailed description of the preferred embodiment is read in conjunction with the drawings which illustrate such embodiment.

DESCRIPTION OF THE PREFERRED EMBODIMENT

Figure 1:
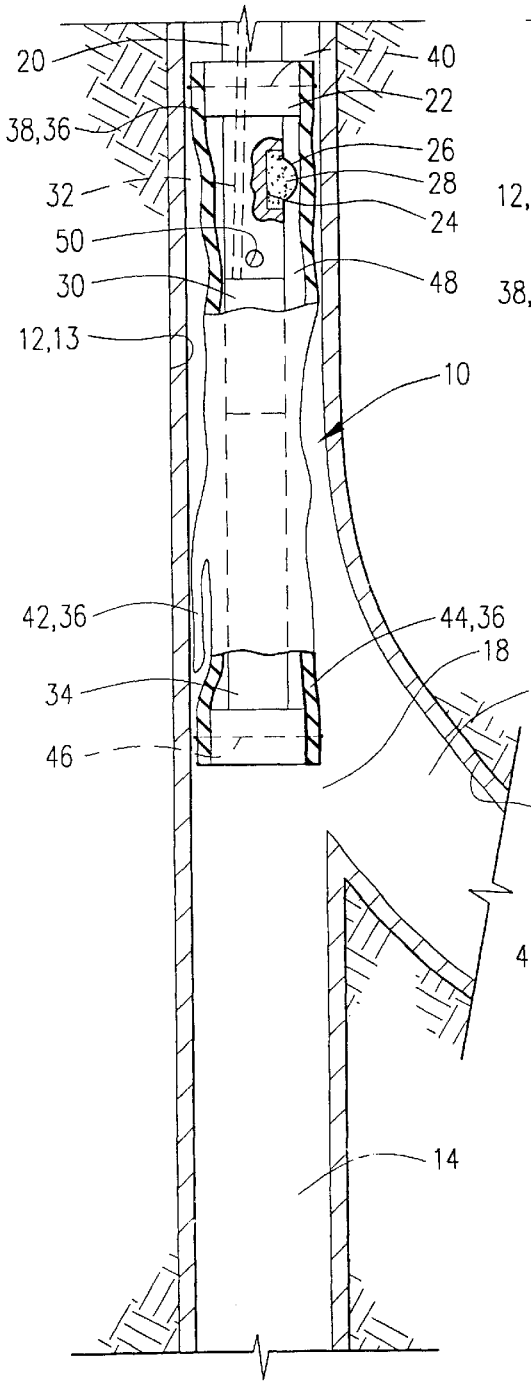
FIG. 1 shows the apparatus for connecting casing to lateral casing of the present invention as it is run into a well adjacent to an intersection between main and lateral casing sections.

Referring now to the drawings, the apparatus for connecting a main casing section to a lateral casing section of the present invention is shown and generally designated by the numeral 10. Apparatus 10 is designed for use in a well 12. Well 12 has a main portion 13 with a casing section 14 therein and a lateral portion 15 extending therefrom with a casing section 16 therein, such that a joint or intersection 18 is formed between the two casing sections 14 and 16.

Apparatus 10 is run into well 12 on a tubing string 20 of a kind known in the art. Tubing string 20 may be a pipe string or a coiled tubing string, or any other means of conveying a tool into a well. As shown in FIG. 1, apparatus 10 is positioned adjacent to intersection 18, ready to be placed in an operating position.

At the upper end of apparatus 10 is a housing 22 adapted for connection to tubing string 20 and defining a cavity 24 therein. Cavity 24 is initially closed by a rupture disc 26 so that a volume of chemicals 28 are retained in the cavity. Chemicals 28 may be contained in a plastic bag (not shown) which is ruptured when pressure is applied thereto. Chemicals 28 are selected to produce heat when released as further described herein. For example, but not by way of limitation, the reaction of acids and metals produce heat. Decomposing mixes such as: $Al+Fl_2O_3 \rightarrow Al_2O_3+Fl$ produces extremely high heat. Another example is the mixing of CaCl+baking soda.

In the illustrated embodiment, a heater 30 is attached to the lower end of housing 22. Heater 30 is of a kind known in the art and is preferably an electrical heater. Wiring 32 extends from heater 30 up through tubing string 20 to a power source (not shown).

A bent sub or tool 34 of a kind known in the art is attached to the lower end of heater 30, and thus housing 22, heater 30 and bent sub 34 are all connected to each other. Bent sub 34 is adapted for guiding a portion of apparatus 10 into lateral casing section 16.

A flexible sock 36 is disposed around housing 22, heater 30 and bent sub 34. Sock 36 has an upper end 38 which is disposed around the upper portion of housing 22. Upper end 38 of sock 36 is attached and sealed to housing 22 using retaining and releasing mechanisms known in the art such as a string 40 which lightly retains sock 36 on housing 22 when positioning apparatus 10, but which is easily broken so that the housing may be removed from the sock when desired, as further described herein. Other known mechanisms such as a releasable clamp could be used.

Sock 36 also has a first leg 42 and a second leg 44. Second leg 44 of sock 36 is disposed around the lower portion of bent sub 34 and sealed and attached thereto by engagement of another retaining and releasing mechanism known in the art, such as string 46. String 46, like string 40 previously described, lightly retains second leg 44 of sock 36 on bent sub 34, but is easily broken so that the bent sub may be removed from the sock when desired, again as further described herein. Again, other known mechanisms such as a releasable clamp may be used instead.

As seen in FIG. 1, sock 36 is in a collapsed configuration draped limply around the other components in apparatus 10. Sock 36 is preferably made of an initially flexible material which may subsequently be hardened. One preferred material is a thermoset plastic material, such as a composite matrix. One specifically preferred composite matrix is a polyamide material reinforced with glass fibers or the like, having a curing temperature of about 550° F., but the invention is not intended to be limited to this one particular thermoset material.

Pressure is applied to tubing string 20 so that an annular volume 48 defined between sock 36 and housing 22, heater 30 and bent sub 34 is pressurized. Pressure is applied to annular volume 48 through means such as a port 50 in housing 22. This application of pressure into annular volume 48 inflates sock 36. Simultaneous with pressurization or subsequently thereto, sock 36 is moved to the operating position shown in FIG. 2. It will be seen that sock 36 conforms to the inner surfaces of main casing section 14 and lateral casing section 16. Sock 36 is preformed to a shape which closely conforms to the casing in well 12 when the sock is inflated as shown in FIG. 2.

Figure 2:
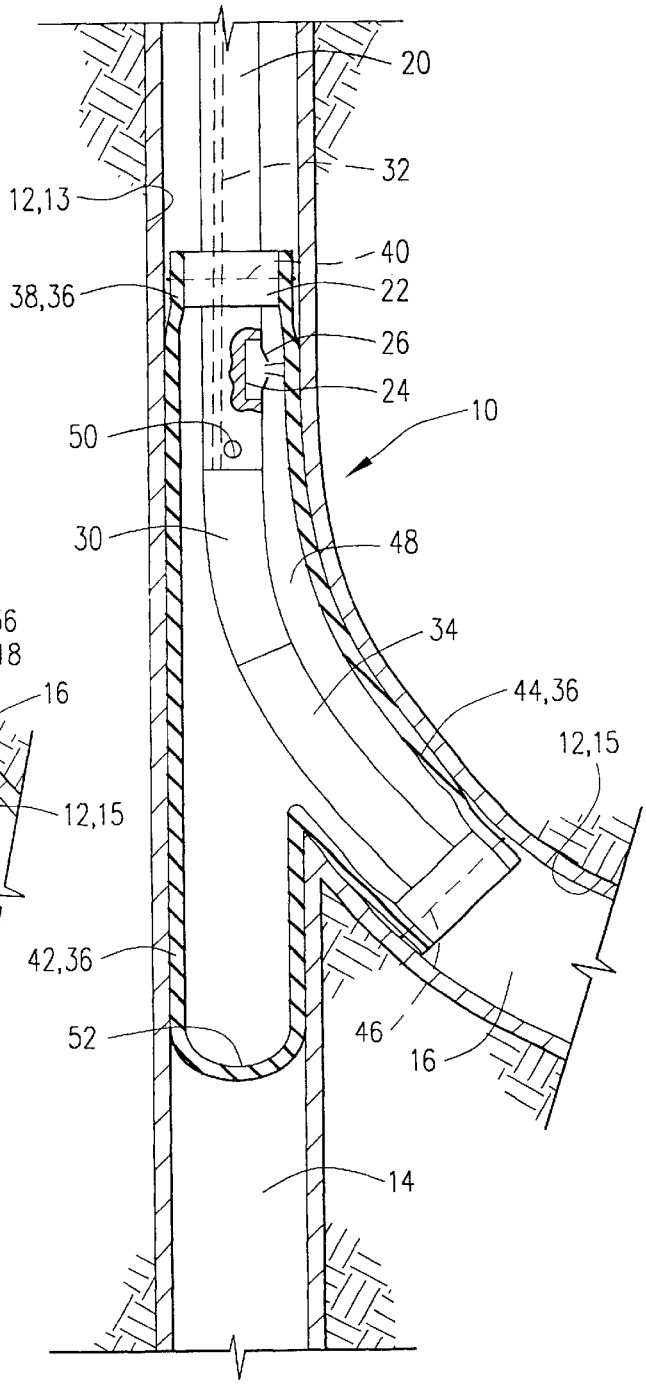
FIG. 2 shows the apparatus in an operating position, forming a seal at the casing intersection.

While positioning, bent sub 34 is manipulated so that it extends at least partially into lateral casing section 16, as seen in FIG. 2. Thus, it will be seen that second leg 44 of sock 36 is guided into lateral casing section 16 and beyond intersection 18. First leg 42 of sock 36 is free to drape down into main casing section 14.

The pressurizing of annular volume 48 also ruptures rupture disc 26 so that chemicals 28 are released from housing 22. The release of chemicals 28 causes an exothermic reaction which applies heat to sock 36. Preferably, sufficient heat is generated that at least partial curing of the hardenable material of sock 36 is initiated.

Additional pressure on sock 36 will break strings 40 and 46. Alternatively, as previously mentioned, other known releasing devices could be used. For example, this connection can be disconnected using a J-slot mechanism. Another means of disconnecting sock 36 could be the application of excessive heat at the top and bottom portions of the sock thus creating a weak and brittle connection between the sock and the component to which it is attached. The invention is not intended to be limited to any particular retaining or releasing means.

If necessary, additional heating may be applied by activating heater 30 to thoroughly cure the material of sock 36.

To facilitate inflation, first leg 42 of sock 36 extends beyond intersection 18 and has a closed end 52. Closed end 52 may be easily cut or drilled out later if desired.

Once sock 36 is set and hardened into the operating position shown in FIG. 2, tubing string 20 may be raised in well 12 which will be seen to remove housing 22, heater 30 and bent sub 34 from the sock. Sock 36 is left in well 12 at intersection 18 to provide a reliable seal at the intersection. The seal is not easily damaged, even with some earth or piping movement. Also, the material for sock 36 may be selected such that it is stable at elevated temperatures and pressures. Also, sock 36 provides a smooth inner surface at intersection 18 so that subsequently run tools into lateral casing section 16 will not hang up.

While the apparatus has been described as using a thermoset plastic material which may be hardened into the operating position, the invention is not intended to be limited to this particular type of material. Other materials which may be molded into a flexible sock and subsequently hardened would also be suitable.

It will be seen, therefore, that the apparatus and method for connecting a main casing section to a lateral casing section using thermoset plastic molding of the present invention is well adapted to carry out the ends and advantages mentioned as well as those inherent therein. While the presently preferred embodiment of an apparatus and method have been described for the purposes of this disclosure, numerous changes in the arrangement and construction of parts in the apparatus and in steps in the method may be made by those skilled in the art. All such changes are encompassed within the scope and spirit of the appended claims.

What is claimed is:

1. An apparatus for sealing a connection between a main casing section and a lateral casing section in a well, said apparatus comprising:

a housing adapter for attachment to a tubing string;

a sock having an upper end attached to said housing, said sock having a first leg and a second leg, said sock being made of a hardenable material; and a bent sub connected to said housing and extending through said second leg of said sock and not extending into said first leg of said sock;

wherein:

said housing, sock and bent sub may be positioned in the well adjacent to au intersection of the main and lateral casing sections;

said bent sub may be manipulated so that it extends at least partially into the lateral casing section, thereby positioning said second leg of said sock in the lateral casing section;

said sock may be inflated into an operating position in which the first leg of said sock extends into the main casing section beyond the intersection of the main and lateral casing sections and the second leg of said sock extends into the lateral casing section beyond the intersection; and said sock may be hardened in said operating position.

2. The apparatus of claim 1 wherein said first leg of said sock has a closed end.

3. The apparatus of claim 1 wherein said housing and said upper end of said sock are sealingly engaged.

4. The apparatus of claim 1 wherein said bent sub and said second leg of said sock are sealingly engaged.

5. The apparatus of claim 1 wherein said sock is made of a thermoset plastic material; and further comprising heating means for applying heat to said sock and thereby hardening said sock in said operating position.

6. The apparatus of claim 5 wherein said heating means comprises a heater connected to said housing.

7. The apparatus of claim 6 wherein said heater is an electric heater.

8. The apparatus of claim 5 wherein said thermoset plastic material is a composite matrix.

9. The apparatus of claim 8 wherein said composite matrix is a polyamide with reinforcing fibers therein.

10. The apparatus of claim 9 wherein said fibers are glass.

11. The apparatus of claim 9 wherein said polyamide has a curing temperature of about 550° F.

12. The apparatus of claim 1 further comprising means for releasing said housing and bent sub from said sock after hardening thereof.

13. The apparatus of claim 12 wherein said means for releasing comprises string initially attaching said upper end of said sock to said housing and said second leg of said sock to said bent sub, said string being broken by applying pressure in said sock.

14. An apparatus for forming a seal at an intersection between a main casing section and a lateral casing section in a well, said apparatus comprising:

a tubing string;

a housing attached to said tubing string, said housing defining an outwardly opening cavity therein;

a volume of chemicals disposed in said cavity and adapted for providing an exothermic reaction when released from said cavity;

a rupture disc disposed across said cavity for initially retaining said chemicals in said cavity, said rupture disc being rupturable in response to pressure applied thereto for releasing said chemicals; and a sock made of a thermosetting material and inflatable to an operating position, said sock comprising:

an upper end attached to said housing and enclosing said rupture disc;

a first leg which extends beyond the intersection into the main casing section when said sock is inflated to said operating position; and a second leg which extends beyond the intersection into the lateral casing section when said sock is inflated to said operating position;

wherein, said exothermic reaction provides sufficient heat to at least partially cure said thermosetting material when said sock is in said operating position.

15. The apparatus of claim 14 further comprising a bent sub connected to said housing and extending through said second leg of said sock for guiding said second leg into the lateral casing section.

16. The apparatus of claim 15 further comprising a seal between said bent sub and said second leg of said sock.

17. The apparatus of claim 14 further comprising a seal between said housing and said upper end of said sock.

18. The apparatus of claim 17 wherein said seal is above said rupture disc.

19. The apparatus of claim 14 wherein said first leg of said sock has a closed end.

20. The apparatus of claim 14 wherein said thermosetting material is a composite matrix.

21. The apparatus of claim 20 wherein said composite matrix comprises reinforced polyamide.

22. The apparatus of claim 14 further comprising a heater connected to said housing and enclosed by said sock, said heater providing sufficient heat when activated for substantially completely curing said thermosetting material.

23. The apparatus of claim 22 wherein said heater is an electric heater, and further comprising wiring running through said tubing string and connected to said electric heater.

24. The apparatus of claim 14 further comprising a string for attaching said sock to said housing, said string being breakable in response to pressure applied in said sock.

25. A method of connecting and sealing between a main casing section and a lateral casing section in a well, said method comprising the steps of:

(a) positioning a flexible sock made of a hardenable material adjacent to an intersection of the main and lateral casing sections, said sock comprising a first leg and a second leg;

(b) placing said sock in an operating position wherein said first leg of said sock is in contact with an inner surface of the main casing section and using a bent sub disposed inside said second leg of said sock and not extending into said first leg of said sock to position said second leg of said sock such that it extends into the lateral casing section and is in contact with an inner surface thereof; and (c) curing said hardenable material such that said sock is hardened in said operating position.

26. The method of claim 25 wherein, in step (a), said sock is made of a polyamide.

27. The method of claim 25 wherein step (b) comprises inflating said sock.

28. The method of claim 25 wherein step (c) comprises applying heat to said hardenable material.

29. The method of claim 28 wherein said step of heating comprises activating a heater positioned adjacent to said sock.

30. An apparatus for sealing a connection between a main casing section and a lateral casing section in a well, said apparatus comprising:

a housing adapted for attachment to a tubing string, said housing defining a cavity therein;

a sock having an upper end attached to said housing, said sock having a first leg and a second leg, said sock being made of a hardenable, thermoset plastic material;

a bent sub connected to said housing and extending through said second leg of said sock; and heating means comprising chemicals disposed in said cavity for providing an exothermic reaction when released therefrom for applying heat to said sock;

wherein:

said housing, sock and bent sub may be positioned in the well adjacent to an intersection of the main and lateral casing sections;

said sock may be inflated and placed in an operating position in which said first leg of said sock extends into the main casing section beyond the intersection of the main and lateral casing sections and the second leg of said sock extends into a lateral casing section beyond the intersection; and heat from said heating means hardens said sock in said operating position.

31. The apparatus of claim 30 further comprising a rupture disc in communication with said cavity such that said rupture disc may be ruptured by applying pressure thereto, thereby releasing said chemicals from said cavity.

32. A method of connecting and sealing between a main casing section and a lateral casing section in a well, said method comprising the steps of:

(a) positioning a flexible sock made of a hardenable material adjacent to an intersection of the main and lateral casing sections, said sock comprising a first leg and a second leg;

(b) placing said sock in an operating position wherein said first leg of said sock is in contact with an inner surface of the main casing section and said second leg of said sock is in contact with an inner surface of the lateral casing section; and (c) curing said hardenable material by applying heat thereto by releasing a volume of chemicals adjacent to said sock such that an exothermic reaction is generated and said sock is hardened in said operating position.

33. The method of claim 32 wherein step (a) comprises positioning a housing containing said volume of chemicals inside said sock.

34. The method of claim 33 wherein said step of releasing said chemicals comprises rupturing a rupture disc retaining said chemicals in said housing.

35. The method of claim 34 wherein step (b) comprises inflating said sock.

36. The method of claim 35 wherein step (b) and step (c) are substantially simultaneous.

* * * * *